US012523209B2

(12) United States Patent
Van Den Oetelaar

(10) Patent No.: US 12,523,209 B2
(45) Date of Patent: Jan. 13, 2026

(54) COMPRESSOR ASSEMBLY

(71) Applicant: GEA Refrigeration Netherlands N.V., 's-Hertogenbosch (NL)

(72) Inventor: Joseph Johannes Adrianus Maria Van Den Oetelaar, Den Dungen (NL)

(73) Assignee: GEA REFRIGERATION NETHERLANDS N.V., S-Hertogenbosch (NL)

( * ) Notice: Subject to any disclaimer, the term of this patent is extended or adjusted under 35 U.S.C. 154(b) by 0 days.

(21) Appl. No.: 18/847,513

(22) PCT Filed: Mar. 17, 2023

(86) PCT No.: PCT/NL2023/050139
§ 371 (c)(1),
(2) Date: Sep. 16, 2024

(87) PCT Pub. No.: WO2023/177299
PCT Pub. Date: Sep. 21, 2023

(65) Prior Publication Data

US 2025/0207572 A1 Jun. 26, 2025

(30) Foreign Application Priority Data

Mar. 17, 2022 (NL) ..... 2031315

(51) Int. Cl.
*F04B 37/00* (2006.01)
*F04B 53/16* (2006.01)
*F04B 53/18* (2006.01)

(52) U.S. Cl.
CPC ..... *F04B 37/00* (2013.01); *F04B 53/16* (2013.01); *F04B 53/18* (2013.01)

(58) Field of Classification Search
CPC ..... F04B 37/00; F04B 53/16; F04B 53/18; F04B 27/053; F04B 35/01; F04B 39/123; F04B 39/125; F04B 39/16
See application file for complete search history.

(56) References Cited

U.S. PATENT DOCUMENTS 2,449,740 A * 9/1948 Felser, Jr. ..... F04B 49/00 417/279
3,066,857 A * 12/1962 Mccloy ..... F04B 39/0077 417/415

(Continued)

FOREIGN PATENT DOCUMENTS

EP 1 431 087 A2 6/2004
EP 1 906 017 A1 4/2008

OTHER PUBLICATIONS

International Search Report, issued in PCT/NL2023/050139, dated May 17, 2023.

(Continued)

*Primary Examiner* — Matthew T Largi
(74) *Attorney, Agent, or Firm* — Birch, Stewart, Kolasch & Birch, LLP

(57) ABSTRACT

A compressor assembly includes a compressor of the reciprocating piston type. The compressor includes a cylinder head bounding a cylinder head chamber. Each cylinder head chamber is connected via a condensate drain pipe to a condensate collection chamber so as to form a condensate connection. A first end of the condensate drain pipe is connected with the cylinder head and a second end of the condensate drain pipe is connected with the condensate collection chamber. The first end of the condensate drain pipe is at a highest level of the condensate drain pipe and all other parts of the condensate drain pipe are at lower levels (Continued)

so that transport of condensate through the condensate drain pipe takes place under the effect of gravity.

11 Claims, 6 Drawing Sheets

(56) References Cited

U.S. PATENT DOCUMENTS

| | | | | |
|---|---|---|---|---|
| 4,298,314 | A * | 11/1981 | Thayer | F04B 39/128<br>417/415 |
| 5,288,211 | A * | 2/1994 | Fry | F04B 39/0055<br>181/403 |
| 8,690,545 | B2 * | 4/2014 | Martin | F04B 39/02<br>417/87 |
| 9,021,830 | B2 * | 5/2015 | Etter | F04B 27/1804<br>62/470 |
| 2002/0006339 | A1 * | 1/2002 | Ota | F04B 27/1081<br>417/270 |
| 2003/0188545 | A1 * | 10/2003 | Ramachandran | F04B 39/1006<br>62/77 |
| 2010/0282073 | A1 * | 11/2010 | Bon | F04B 39/128<br>228/173.6 |

OTHER PUBLICATIONS

Written Opinion of the International Searching Authority, issued in PCT/NL2023/050139, dated May 17, 2023.

* cited by examiner

COMPRESSOR ASSEMBLY

FIELD

The invention relates to a compressor assembly.

BACKGROUND

In the context of the present invention, the compressor assembly comprises a compressor. An example of a compressor is described in WO 2009/067014. Compressors of a similar type are also marketed by an affiliate of applicant under the brand GEA GRASSO V SERIES. The known compressor is of the reciprocating type and comprises:

- a compressor housing,
- at least one cylinder,
- at least one piston which is reciprocally moveably arranged in the at least one cylinder and driveable by a crankshaft/piston-rod assembly,
- at least one cylinder head bounding a cylinder head chamber which is associated with the at least one cylinder,
- at least one discharge valve, wherein between the at least one cylinder and the cylinder head chamber associated therewith a respective one of the at least one discharge valve is mounted which opens when an over-pressure prevails in the cylinder relative to the pressure prevailing in the cylinder head chamber associated therewith,
- a compressed gas outlet which is fluidly connected with the at least one cylinder head chamber.

In practice, the compressed gas outlet of the compressor is frequently connected via a compressed gas pipe to an oil separator vessel so that therein a pressure prevails which is substantially equal to the pressure in the cylinder head chamber.

SUMMARY

A problem of the known compressors is the formation of condensate, i.e. liquid, which may accumulate in the cylinder head chamber See in this respect FIG. 6 which is a cross section of a prior art compressor in which condensate C is accumulated in the cylinder head chamber 24 up to a level that it leaks into the cylinder 16. When the liquid level in the cylinder head chamber becomes too high, the liquid may leak into the cylinder via the discharge valve and with the subsequent compression stroke serious damage may be the consequence. Another negative consequence may be that the liquid may wash away the lubricating oil film from the cylinder liner.

From practice it is known to heat the cylinder head and consequently maintain the temperature of the gas in the cylinder head chamber above the dew point temperature so that the formation of condensate may be reduced or prevented. However, such a solution is costly in that it requires energy to generate the heat for heating the cylinder head. Additionally, the constructive measures which have to be taken to be able to heat the cylinder head are also cumbersome and may require additional servicing.

U.S. Pat. No. 4,298,314 also deals with the problem of condensate formation in the cylinder head. In that publication, the cylinder head is provided with a drain valve which, when being in the open condition, connects the cylinder head chamber with oil sump of the compressor. The drain valve is spring loaded and opens under the action of the spring when the compressor is non-operative. When the compressor is operative, the higher pressure prevailing in the cylinder head chamber relative to the pressure prevailing in the oil sump of the compressor causes the drain valve to be closed. At a certain point after shutting down the compressor, the pressure prevailing in the cylinder head drops to a level at which the drain valve opens. Thus, drainage only is possible during the non-operative state of the compressor and, additionally, for this solution it is required that the pressure in the cylinder head drops to the pressure prevailing in the oil sump so that the cylinder head chamber is brought into fluid connection with the oil sump via the drain valve. Such a pressure drop is in many cases not desired and, in practice, may be prevented by means of the implementation of check valves. Another disadvantage is that the drained liquid dissolves in the oil in the sump and degrades lubrication properties of the oil in the oil sump.

Thus, the object of the present invention is to provide a compressor assembly in which the condensate problem of the prior art compressor is solved or at least alleviated.

To that end, the invention provides a compressor assembly according to claim 1. More in particular, the compressor assembly described in the background section is, according to the invention characterized in by a condensate collection chamber and a condensate drain pipe. The condensate collection chamber is connected with the compressed gas outlet so that in the condensate collection chamber a pressure prevails which is substantially equal to the pressure in the cylinder head chamber. The condensate drain pipe connects the at least one cylinder head chamber to the condensate collection chamber so as to form a condensate fluid connection. A first end of the condensate drain pipe is connected with the cylinder head and a second end of the condensate drain pipe is connected with the condensate collection chamber. The first end of the condensate drain pipe is at a highest level of the condensate drain pipe and all other parts of the condensate drain pipe are at lower levels so that transport of condensate through the condensate drain pipe takes place under the effect of gravity.

The condensate collection chamber is connected to the compressed gas outlet of the compressor so that the pressure which prevails in the condensate collection chamber is substantially equal to the pressure in the cylinder head chamber. By virtue thereof, there may be an open connection via the condensate drain pipe between the cylinder head chamber and the condensate collection chamber during operation. Thus, even during operation of the compressor, any condensate which may be formed during use of the compressor may be drained to the condensate collection chamber. Of course, drainage is also possible when the compressor is non-operative because the pressure in the condensate collection chamber remains substantially equal to the pressure prevailing in the cylinder head. The solution does not include any moving components and the costs thereof may be very low. Also, servicing of the condensate drain pipe and the condensate collection chamber is minimal if at all necessary. As explained in the background section, the compressed gas outlet of the compressor may be connected to a compressed gas pipe. Optionally, an oil separator vessel may be connected to the compressed gas pipe so that therein a pressure prevails which is substantially equal to the pressure in the cylinder head chamber.

In an embodiment, the condensate connection between the cylinder head chamber and the condensate collection chamber may be an open connection without any valves.

Due to the absence of any valves in the condensate connection, the solution of this embodiment is fail safe. Indeed, the chance that a valve body becomes stuck is absent in the absence of any valves in the condensate connection.

Additional embodiments are described in the dependent claims. Embodiments of the inventions will be described with reference to the figures in which some non-limiting examples of a compressor assembly according to the invention are shown.

DETAILED DESCRIPTION

Figure 1:
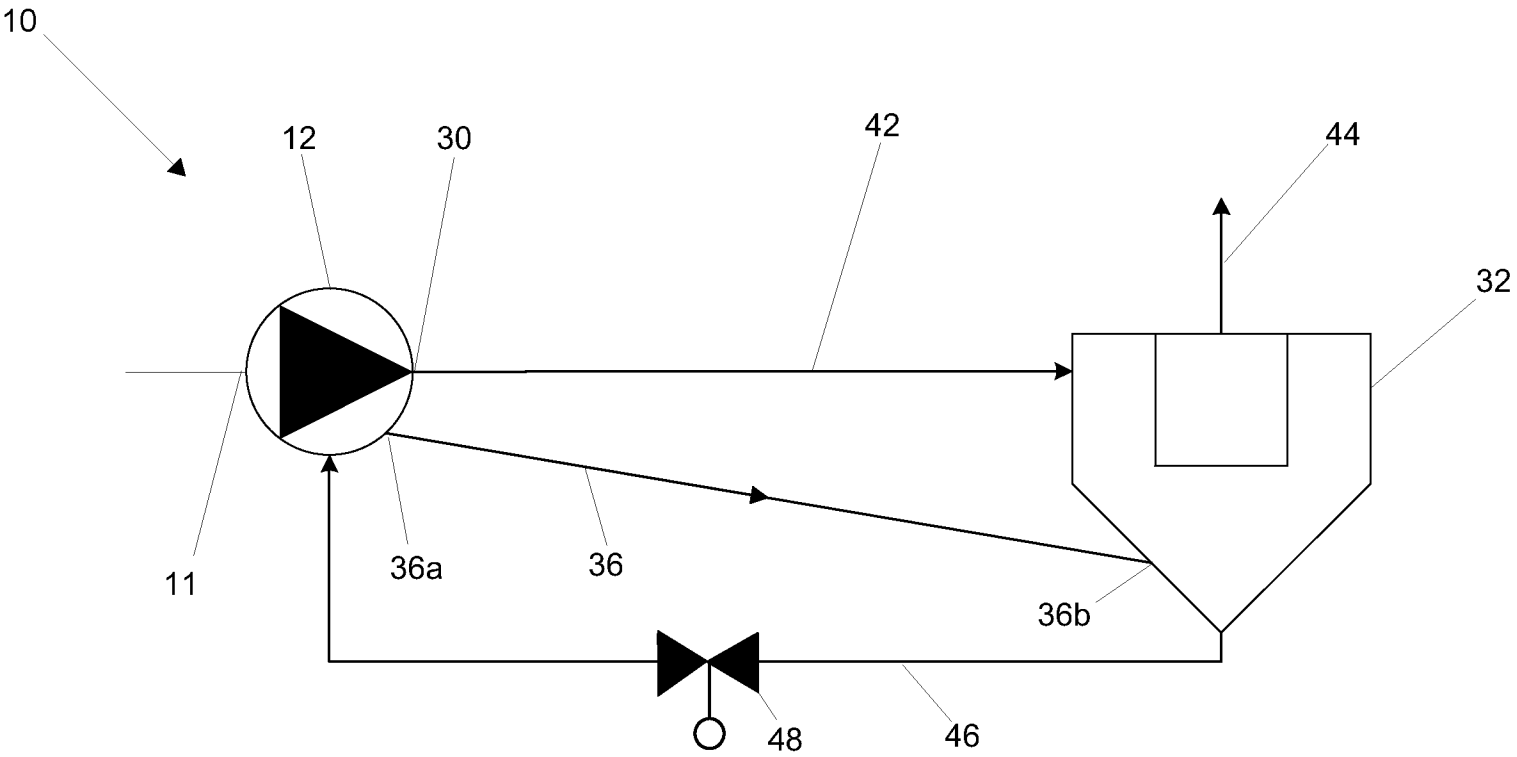
FIG. 1 schematically shows an example of a first embodiment of a compressor assembly according to the invention.

FIG. 1 shows an example of a first embodiment of a compressor assembly 10 according to the invention. The assembly comprises a compressor 12 having a gas inlet 11 and a gas compressed gas outlet 30. Via a compressed gas pipe 42, the compressor 12 may be connected to a pressure vessel which, in this embodiment is an oil separator vessel 32. In the oil separator vessel 32, the mixture of compressed gas and oil supplied via compressed gas pipe 42 is separated. The compressed gas leaves the oil separator vessel 32 via a discharge pipe 44. The oil which is in the lower part of the oil separator vessel 32 may be returned to the compressor 12 via line 46 in which a valve 48 may be included to control the flow of oil back to the compressor 12. In an alternative embodiment, the line 46 may lead to an oil collection vessel in which the oil may be cooled or used for other purposes. The pressure prevailing in the oil separator vessel 32 is substantially equal to the pressure in the cylinder head chambers of the compressor 12.

In accordance with the invention, the compressor assembly 10 is characterized by a condensate collection chamber 32 or 34 which is connected with the compressed gas outlet 30 so that in the condensate collection chamber 32 or 34 a pressure prevails which is substantially equal to the pressure in the cylinder head chamber 24. The compressor assembly 10 is also characterized by a condensate drain pipe 36 which connects the at least one cylinder head chamber 24 to the condensate collection chamber 32 or 34 so as to form a condensate connection. A first end 36*a* of the condensate drain pipe 36 is connected with the at least one cylinder head 24. A second end 36*b* of the condensate drain pipe 36 is connected with the condensate collection chamber 32 or 34. The first end 36*a* of the condensate drain pipe 36 is at a highest level of the condensate drain pipe 36 and all other parts of the condensate drain pipe 36 are at lower levels so that transport of condensate through the condensate drain pipe 36 takes place under the effect of gravity.

In an embodiment, of which an example is shown in FIG. 1, the condensate collection chamber may be bounded by an oil separator vessel 32, in particular the oil separator vessel 32 which part of an oil separator for separating oil from the compressed gas/oil mixture flow coming from the compressed gas outlet 30 of the compressor 12.

Figure 2:
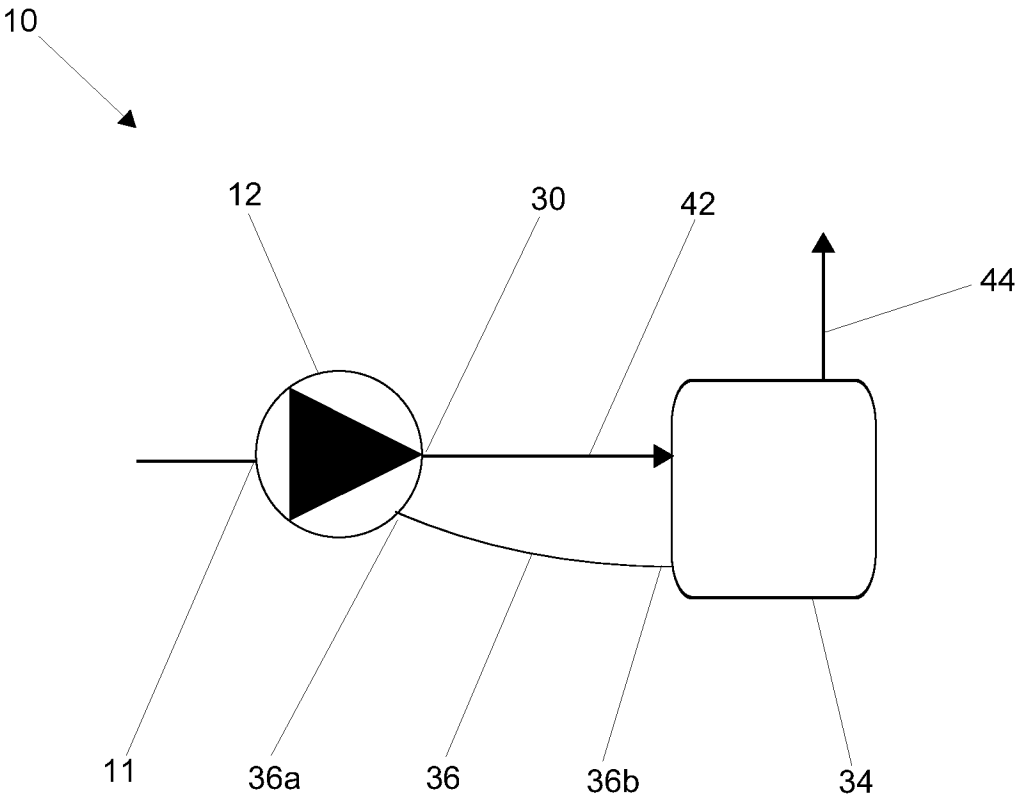
FIG. 2 schematically shows an example of a second embodiment of a compressor assembly according to the invention.

In another embodiment, of which an example is shown in FIG. 2, the condensate collection chamber is bounded by a dedicated condensate drainage vessel 34. Oil separation may not be necessary, for example because the compressor is of the oil free type. Again, the compressor 12 has an inlet 11 and a compressed gas outlet 30. The compressed outlet 30 may be connected to a compressed gas pipe 42 which is connected with the pressure vessel which is embodied as a dedicated condensate drainage vessel 34. The condensate drainage vessel 34 is also connected to a compressed gas discharge pipe 44 for delivery of the compressed gas. Again, in accordance with the invention, the cylinder head chamber of the compressor 12 is connected with a condensate drain pipe 36 to condensate collection chamber, in particular the dedicated condensate drainage pressure vessel 34.

In yet another embodiment, the condensate collection chamber may bounded by an integral part of a compressed gas pipe 42 which is connected to the compressed gas outlet 30 of the compressor 12. The integral part of the compressed gas pipe 42 forming the condensate collection chamber should be at a level lower than that of the cylinder head chamber 24. It may be formed in a lower part of the compressed gas pipe 42 which may, optionally, have locally an increased diameter so as to provide some condensate buffer volume.

Figure 3:
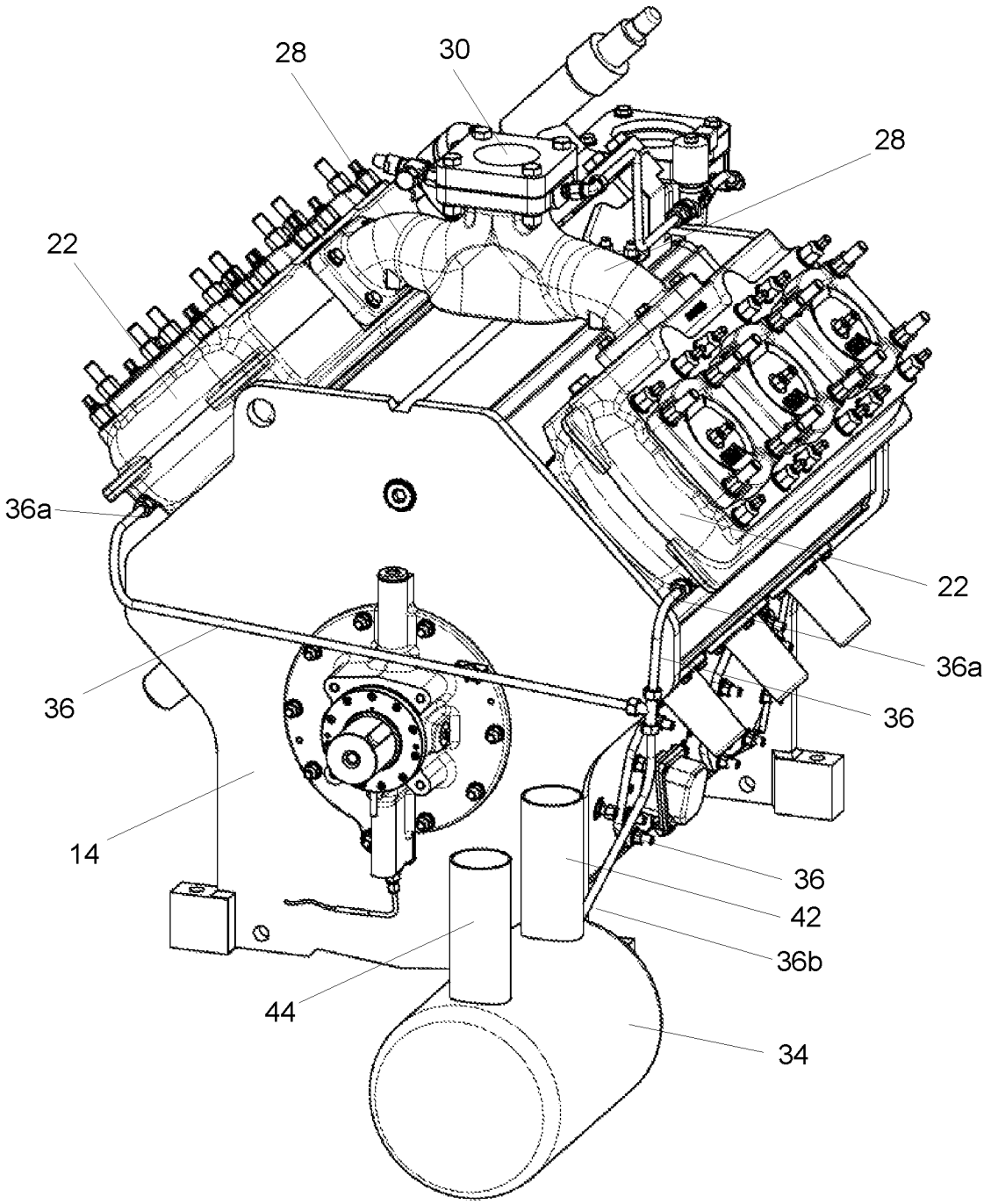
FIG. 3 shows an example of an embodiment of the compressor assembly.
Figure 4:
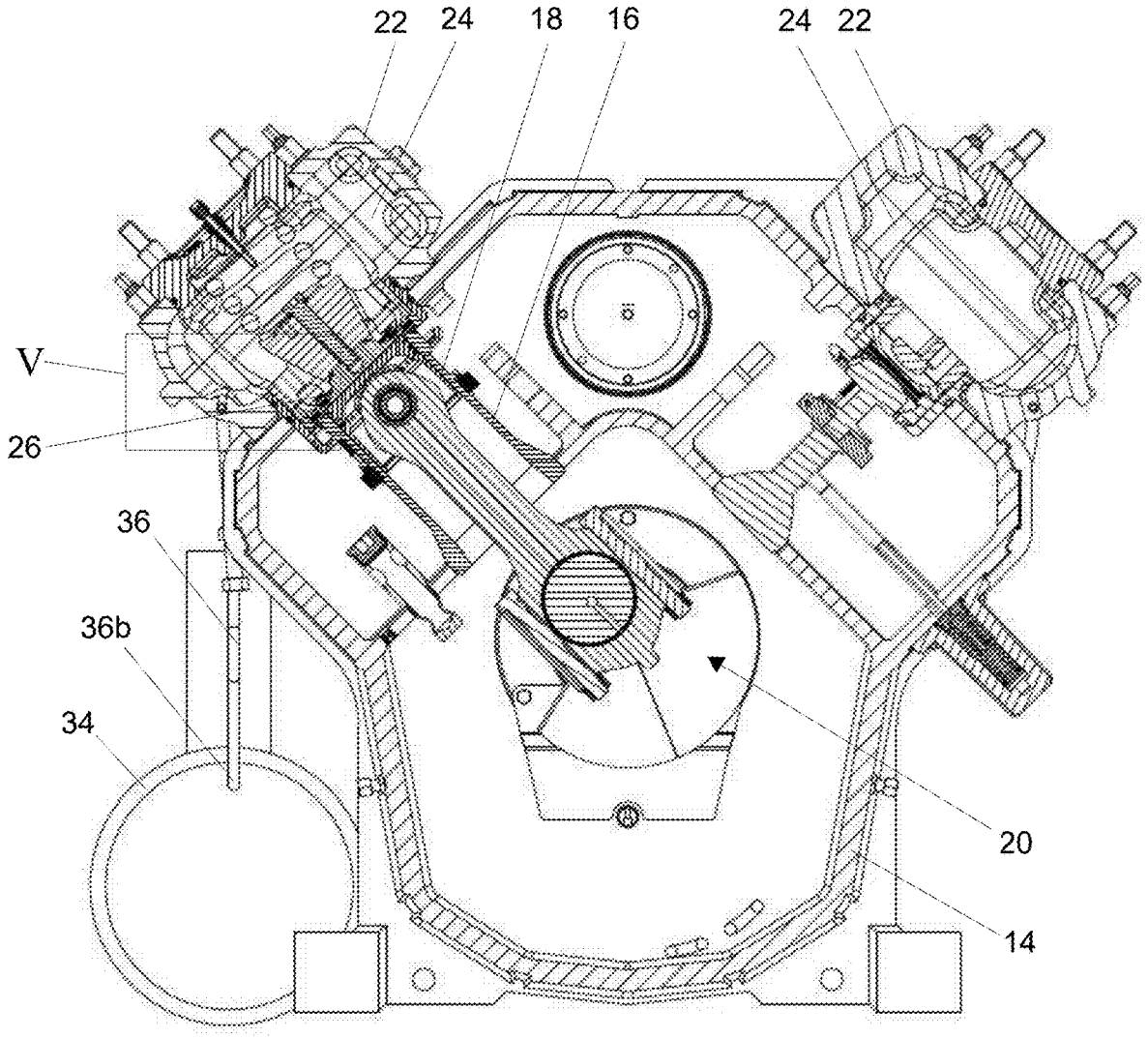
FIG. 4 shows the example from FIG. 3 in cross section.

FIGS. 3 and 4 show a practical example of an embodiment, in particular an embodiment having a dedicated condensate drainage pressure vessel 34. The dedicated condensate drainage vessel 34 is connected via a compressed gas pipe 42 (only partly shown in FIG. 3) to the compressed gas outlet 30 of the compressor. Additionally, the condensate drainage vessel 34 has a compressed gas discharge pipe 44 which delivers the compressed gas. The compressor 12 comprises a compressor housing 14, at least one cylinder 16, and at least one piston 18 which is reciprocally moveably arranged in the at least one cylinder 16 and driveable by a crankshaft/piston-rod assembly 20. See in this respect especially FIG. 4. At least one cylinder head 22 bounds a cylinder head chamber 24 which is associated with the at least one cylinder 16. The compressor 12 also comprises at least one discharge valve 26. More in particular, between the at least one cylinder 16 and the cylinder head chamber 24 associated therewith, a respective one of the at least one discharge valve 26 is mounted which opens when an overpressure prevails in the cylinder 16 relative to the pressure prevailing in the cylinder head chamber 24 associated therewith. The compressed gas outlet 30 is fluidly connected with the at least one cylinder head chamber 24. In the example shown in FIGS. 3 and 4, the compressor 12 comprises a plurality of cylinders 16 and a corresponding plurality of pistons 18 and discharge valves 26. In the example shown in FIGS. 3 and 4, the compressor 12 comprises two cylinder heads 22 each bounding a cylinder head chamber 24. In an embodiment having more than one cylinder head 22, a manifold 28 may connect the respective cylinder head chambers 24 with the compressed gas outlet as is visible in FIG. 3.

In an embodiment, which is part of all the examples shown in the figures, the condensate connection between the cylinder head chamber 24 and the condensate collection chamber including the condensate drain pipe 36 may be an open connection without any valves.

In an embodiment, the first end 36*a* of the condensate drain pipe 36 may be connected to drain opening 40 (see Detail V in FIG. 5) in the cylinder head 22.

In one embodiment (not shown) the drain opening 40 may be at a level below the at least one discharge valve 26. Preferably, the drain opening 40 is at the lowest point of the cylinder head chamber 24 so that any drainage that may be formed in the cylinder head chamber 24 is immediately drained to the pressure vessel 32 or 34. Thus, the risk that any liquid enters the cylinder 16 and causes damage is minimized.

Figure 5:
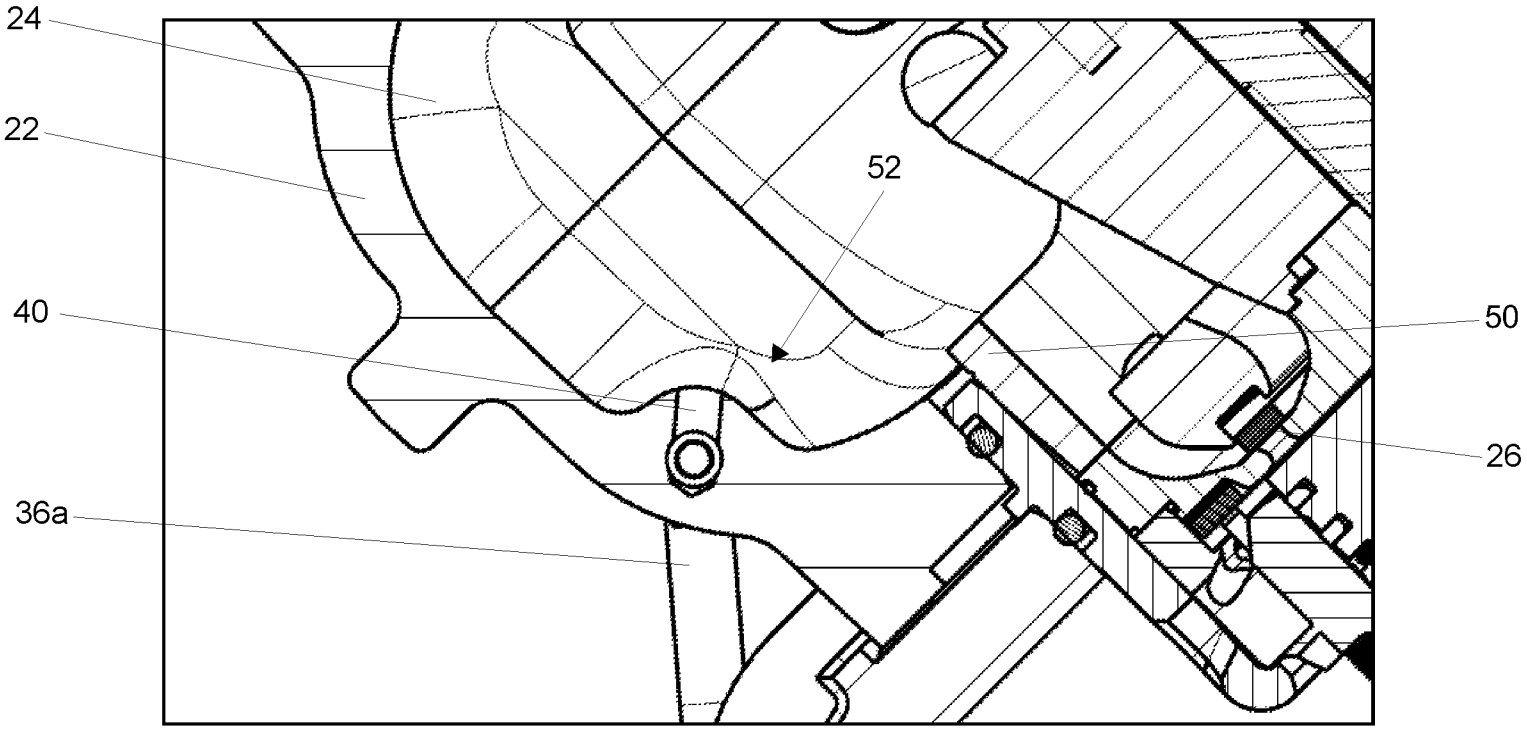
FIG. 5 shows detail V from FIG. 4.
Figure 6:
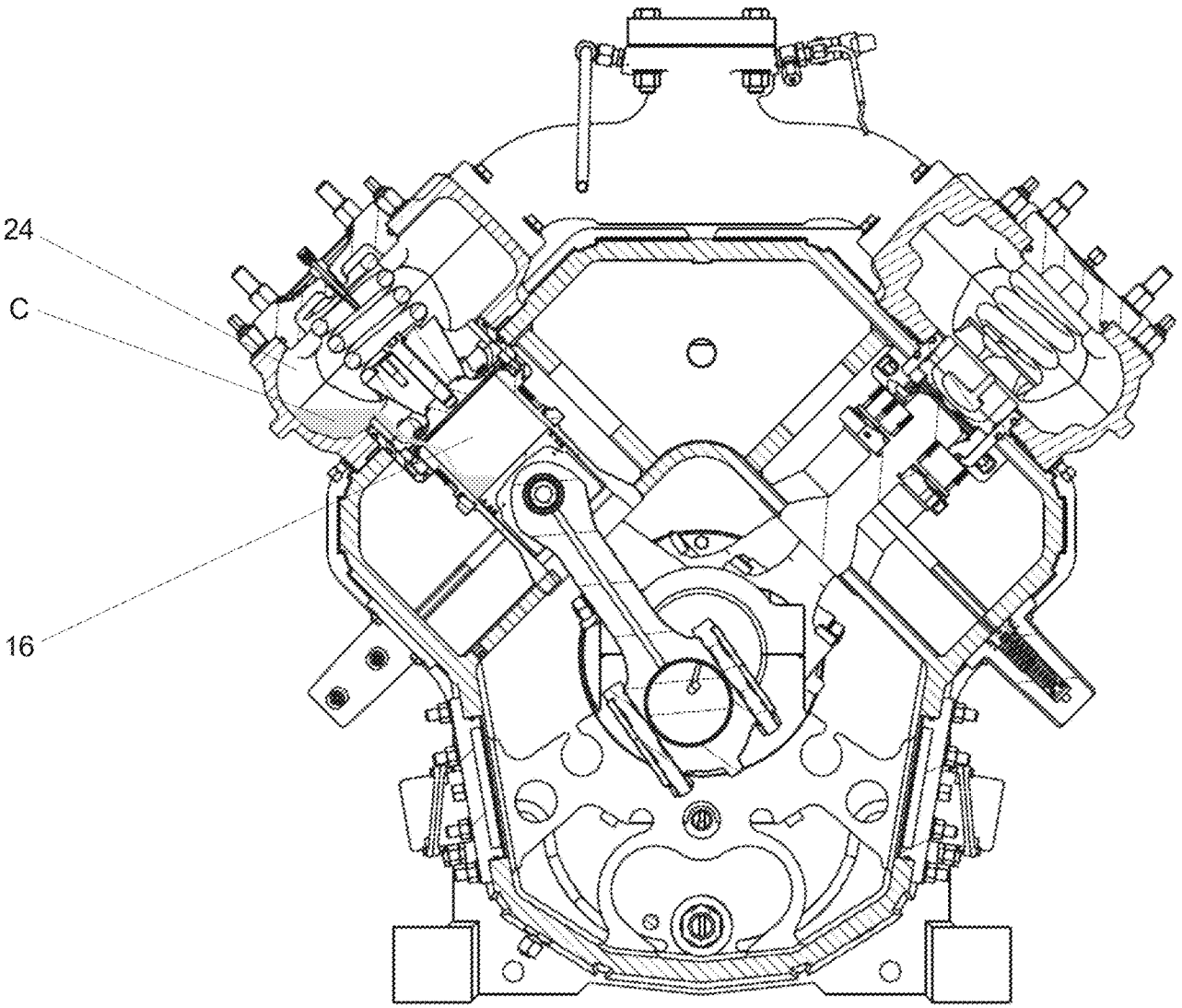
Fig. 6 Prior Art
FIG. 6 shows a relevant part of a cylinder head chamber of a compressor according to the prior art in which condensate is accumulated.

In an alternative embodiment, of which an example is shown in FIG. 5, the cylinder head chamber 24 may contain a part which forms a dam 50 for condensate liquid so as to form a condensate reservoir 52 in the cylinder head chamber 24. The drain opening 40 opens into the condensate reservoir 52. The dam 50 blocks a flow of condensate from the condensate reservoir 52 to the at least one discharge valve 26.

FIGS. 3 and 4 show a six cylinder compressor 12 having a V-configuration. However, the invention is also applicable with other types of compressors, e.g. compressors in which the cylinders are arranges in line or in a W-configuration. The invention is applicable in compressors having any number of cylinders and pistons, including a compressor having only a single cylinder and one piston.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this description are not necessarily all referring to the same embodiment.

Furthermore, it is noted that particular features, structures, or characteristics of one or more of the various embodiments which are described above may be used implemented independently from one another and may be combined in any suitable manner to form new, not explicitly described embodiments. The reference numbers used in the detailed description and the claims do not limit the description of the embodiments, nor do they limit the claims. The reference numbers are solely used to clarify.

The invention claimed is:

1. A compressor assembly comprising:

a compressor of a reciprocating type including:

a compressor housing;

at least one cylinder;

at least one piston reciprocally moveably arranged in the at least one cylinder and driveable by a crankshaft/piston-rod assembly;

at least one cylinder head bounding a cylinder head chamber associated with the at least one cylinder;

at least one discharge valve, wherein between the at least one cylinder and the cylinder head chamber associated therewith, a respective one of the at least one discharge valve is mounted which opens when an over-pressure prevails in the cylinder relative to a pressure prevailing in the cylinder head chamber associated therewith; and a compressed gas outlet emanating in a compressed gas pipe fluidly connected with the at least one cylinder head chamber;

a condensate collection chamber connected with the compressed gas outlet so that in the condensate collection chamber a pressure prevails substantially equal to the pressure in the cylinder head chamber; and a condensate drain pipe which connects the at least one cylinder head chamber to the condensate collection chamber so as to form a condensate connection, wherein a first end of the condensate drain pipe is connected with the cylinder head and wherein a second end of the condensate drain pipe is connected with the condensate collection chamber, wherein the first end of the condensate drain pipe is at a highest level of the condensate drain pipe and all other parts of the condensate drain pipe are at lower levels so that transport of condensate through the condensate drain pipe takes place under an effect of gravity, and wherein the condensate connection between the cylinder head chamber and the condensate collection chamber including the condensate drain pipe is an open connection without any valves.

2. The compressor assembly according to claim 1, wherein the condensate collection chamber is bounded by an oil separator vessel.

3. The compressor assembly according to claim 2, wherein the first end of the condensate drain pipe is connected to a drain opening in the cylinder head.

4. The compressor assembly according to claim 1, wherein the condensate collection chamber is bounded by a dedicated condensate drainage pressure vessel.

5. The compressor assembly according to claim 4, wherein the first end of the condensate drain pipe is connected to a drain opening in the cylinder head.

6. The compressor assembly according to claim 1, wherein the condensate collection chamber is bounded by an integral part of a compressed gas pipe connected to the compressed gas outlet of the compressor, wherein the integral part of the compressed gas pipe forming the condensate collection chamber is at a level lower than that of the cylinder head chamber.

7. The compressor assembly according to claim 6, wherein the first end of the condensate drain pipe is connected to a drain opening in the cylinder head.

8. The compressor assembly according to claim 1, wherein the first end of the condensate drain pipe is connected to a drain opening in the cylinder head.

9. The compressor according to claim 8, wherein the drain opening is at a level below the at least one discharge valve.

10. The compressor according to claim 9, wherein the drain opening is at a lowest point of the cylinder head chamber.

11. The compressor according to claim 8, wherein the cylinder head chamber comprises a part which forms a dam for condensate liquid so as to form a condensate reservoir in the cylinder head chamber, wherein the drain opening opens into the condensate reservoir, wherein the dam blocks a flow of condensate from the condensate reservoir to the at least one discharge valve.

* * * * *